FIP8011 XR 4,005,750

United States Patent [19]

Shuck

[11] 4,005,750

[45] Feb. 1, 1977

[54] METHOD FOR SELECTIVELY ORIENTING INDUCED FRACTURES IN SUBTERRANEAN EARTH FORMATIONS

[75] Inventor: Lowell Z. Shuck, Morgantown, W. Va.

[73] Assignee: The United States of America as represented by the United States Energy Research and Development Administration, Washington, D.C.

[22] Filed: July 1, 1975

[21] Appl. No.: 592,482

[52] U.S. Cl. ..... 166/308; 166/245; 166/250

[51] Int. Cl.[2] ..... E21B 43/26

[58] Field of Search ..... 166/308, 271, 259, 280, 166/281, 283, 245

[56] References Cited

UNITED STATES PATENTS

| | | | |
|---|---|---|---|
| 3,270,816 | 9/1966 | Staadt | 166/308 X |
| 3,419,070 | 12/1968 | Ernst | 166/308 X |
| 3,455,391 | 7/1969 | Matthews et al. | 166/308 X |
| 3,501,201 | 3/1970 | Closmann et al. | 166/271 X |
| 3,682,246 | 8/1972 | Closmann | 166/259 X |
| 3,709,295 | 1/1973 | Braunlich, Jr. et al. | 166/271 X |
| 3,712,379 | 1/1973 | Hill | 166/308 X |
| 3,822,747 | 7/1974 | Maguire, Jr. | 166/308 X |
| 3,884,303 | 5/1975 | Closmann | 166/308 |

*Primary Examiner*—Stephen J. Novosad
*Attorney, Agent, or Firm*—Dean E. Carlson; David S. Zachry; Earl L. Larcher

[57] ABSTRACT

The orientation of hydraulically-induced fractures in relatively deep subterranean earth formations is normally confined to vertical projections along a plane parallel to the maximum naturally occurring (tectonic) compressive stress field. It was found that this plane of maximum compressive stress may be negated and, in effect, re-oriented in a plane projecting generally orthogonal to the original tectonic stress plane by injecting liquid at a sufficiently high pressure into a wellbore fracture oriented in a plane parallel to the plane of tectonic stress for the purpose of stressing the surrounding earth formation in a plane generally orthogonal to the plane of tectonic stress. With the plane of maximum compressive stress re-oriented due to the presence of the induced compressive stress, liquid under pressure is injected into a second wellbore disposed within the zone influenced by the induced compressive stress but at a location in the earth formation laterally spaced from the fracture in the first wellbore for effecting a fracture in the second wellbore along a plane generally orthogonal to the fracture in the first wellbore.

6 Claims, 18 Drawing Figures

METHOD FOR SELECTIVELY ORIENTING INDUCED FRACTURES IN SUBTERRANEAN EARTH FORMATIONS

The present invention is directed generally to a method for fracturing geological earth formations for facilitating the recovery of energy resources, especially oil and gas, and more particularly to a method of selectively orienting the fractures in such earth formation to significantly increase the efficiency of the energy resources recovery operation.

The primary recovery of oil from a subterranean or sub-surface oil-bearing sandstone formation is accomplished by drilling a well-bore from a surface site into the sand formation and then using natural and induced pressure in the formation to force the oil to the surface. This type of recovery operation is very inefficient since at least about 70 percent of the oil reserve remains in the sandstone after this primary recovery operation is completed. Efforts to increase the productivity or recovery efficiency of the oil fields include the use of secondary and tertiary recovery techniques which include induced fracturing and water flooding operations.

Of particular interest in secondary recovery operations is the induced fracturing technique which has been responsible for appreciably increasing the oil recovery efficiency. Inducing the fractures in the oil-bearing sandstone by hydraulic pressure is a well-known technique frequently employed where the permeability of the sandstone formation is insufficient to allow the oil to flow into or out of the formation at a rate which is economically suitable. In the typical induced fracturing operation a fracturing fluid, such as a high viscosity liquid, oil and water dispersion, oil and water emulsion, or water, is pumped into the wellbore to pressurize the latter to a point where the stress levels surrounding the wellbore reach the critical breaking strength of the earth formation in situ so as to initiate a fracture in the earth formation that normally propagates in opposite directions from the well-bore. By continuing the injection of the fracturing fluid into the wellbore, the fracture may continue its growth until it extends a length of several hundred feet. The fracture induced in the sub-surface earth formation is normally of a width of about 0.5 inch at the wellbore and tapers down to some dimension on the order of the grain size at the crack tip. The fracture extension in sandstone formation is usually vertically oriented below about 100 feet since fractures of horizontal configuration would necessitate the lifting of the overburden which requires a relatively high pressure governed by the weight of the overlying formation. This overburden pressure is essentially equal to about 1 pound per square inch per foot of depth. Thus, below about 100 feet, the pressure required for effecting a horizontal fracture would likely be higher than the in situ formation breakdown pressure of the earth formation in the vertical direction. The area of the fracture may be relatively accurately and readily determined by measuring the volume of a viscous fluid injected into the wellbore. The particular hydraulic pressure used for inducing a fracture in any given wellbore may vary from wellbore to wellbore in the same earth formation. Commercially available pumps capable of providing hydraulic fracturing fluids at pressures up to about 5000 psi in the bore have been found to be sufficient to create fractures in oil-bearing earth formations at considerable depths. The utilization of induced fracturing techniques has been estimated to have added approximately 8 billion barrels of petroleum to the United States reserve during the 25-year period of their use which amounts to about 11 percent of the total increase in the reserve added during this period.

The orientation or the direction of the induced fracture in the sub-surface earth formation has been found to be controlled by the orientation of the maximum tectonic compressive stress field, that is, the plane of maximum compressive in situ stress in the snad formation projecting in a relatively horizontal direction as opposed to the vertical compressive stress due to overburden pressure. The tectonic stress field is the naturally occurring absolute state of stress of earth formation in situ. The presence of this stress in sub-surface earth formations presents a directional field or plane of maximum horizontal compression which is usually substantially uniform throughout any given geographic section of the continental United States. For example, in the northeastern United States, the tectonic compressive stress field lies in a plane projecting generally in a North-70° East direction. The orientation of created fractures (the tectonic compressive stress field) in any given location in the continental United States, or any other part of the world, may be readily determined, if not already known, with sufficient accuracy by employing any of several devices or procedures, such as impression packers in the wellbore, acoustic emission from fracturing earth formation by employing a number of suitably placed monitoring sensors for providing a triangulation survey of the fracture direction, and by placing suitable strain gauges or devices in the wellbore and then overcoring the surrounding earth formation to determine the direction of maximum stress relief.

Since the tectonic compressive stress field is always present the hydraulically-induced fracture will necessarily follow the path requiring the least work or minimum energy which path is parallel to the plane of orientation of the tectonic compressive stress field. In other words, an induced fracture will not normally occur along a plane orthogonally disposed to the maximum tectonic stress field since it would require that the fracture follow a path of maximum work. Consequently, while induced fracturing of sub-surface formations provided a marked increase in productivity, some shortcomings or drawbacks are inherently present which detract from achieving an even greater increase in recovery efficiency or productivity. For example, in a developed and fractured oil field, the fractures in adjacent wellbores are likely oriented along parallel planes as dictated by the tectonic compressive stress field so as to inhibit interconnection of the fractures and also leave relatively vast volumes of the earth formations untouched at locations between fractures which are laterally spaced apart from one another, i.e., at locations perpendicular to the plane of tectonic compressive stress field. Further, it has been found that the maximum permeability of the sub-surface formations is usually along a plane disposed parallel to (±20°) the tectonic compressive stress plane. Thus, with the fractures being at least substantially parallel to the tectonic compressive stress field the recovery of petroleum and gas from the sub-surface earth formation is significantly less than would be obtainable if the fractures were projecting along planes generally perpendicular to the plane of maximum permeability.

Accordingly, it is the primary aim or objective of the present invention to obviate or substantially minimize the above and other shortcomings or drawbacks by providing a method of selectively controlling or orienting the direction of induced fractures in subterranean bed or earth formations to facilitate the recovery of energy resources confined within such earth formations. Generally, this method is practiced by the steps of injecting a fluid at a selected pressure into a wellbore penetrating an earth formation containing the energy resources to be recovered and into a previously induced fracture extending into the earth formation from said wellbore along a plane substantially parallel to the plane of the maximum compressive stress for inducing compressive stresses in the earth formation in a horizontal plane disposed generally orthogonal to the plane of maximum compressive stress, continuing the fluid injection until the induced compressive stresses in an area of the earth formation contiguous to the previously induced fracture are greater than the maximum compressive stress so as to negate the latter in the area while stressing the earth formation in the plane disposed generally orthogonal to the maximum compressive stress, and while maintaining the induced compressive stress, injecting fluid at a selected pressure into a second wellbore penetrating the earth formation in the area at a location laterally displaced from the previously induced fracture and under the influence of the induced compressive stress for effecting a fracture along a plane generally parallel to the plane of the induced compressive stress and generally orthogonal to the previously induced fracture. Further, by selectively reducing and increasing the injected fluid pressures in laterally spaced apart wellbores so as to alternately compress the subterranean earth formation in orthogonally disposed planes, the fracture system extending between the wellbores may be extensively furcated. Also, by selectively positioning the second wellbore at a location laterally spaced from one of the ends or tips in a wellbore fracture projecting along a plane parallel to the tectonic stress field, the pressure-induced fracture in the second wellbore can be made to orthogonally intersect the plane of maximum permeability if such a plane is not found to be sufficiently parallel to the tectonic stress field.

Other and further objects of the invention will be obvious upon an understanding of the illustrative method about to be described, or will be indicated in the appended claims, and various advantages not referred to herein will occur to one skilled in the art upon employment of the invention in practice. Also, while the description below is primarily directed to the recovery of petroleum from sub-surface oil-bearing sandstone, it will appear clear that the method of the present invention may be utilized for fracturing subterranean earth formations containing other forms of energy resources, such as gas, geothermal energy, coal, oil shales, etc.

Preferred embodiments of the invention have been chosen for the purpose of describing the method of the present invention. The preferred embodiments illustrated are not intended to be exhaustive or to limit the invention to the precise method steps disclosed. They are chosen and described in order to best explain the principles of the invention and their application in practical use to thereby enable others skilled in the art to best utilize the invention in various forms and modifications of the method steps as are best adapted to the particular use contemplated.

Figure 17:
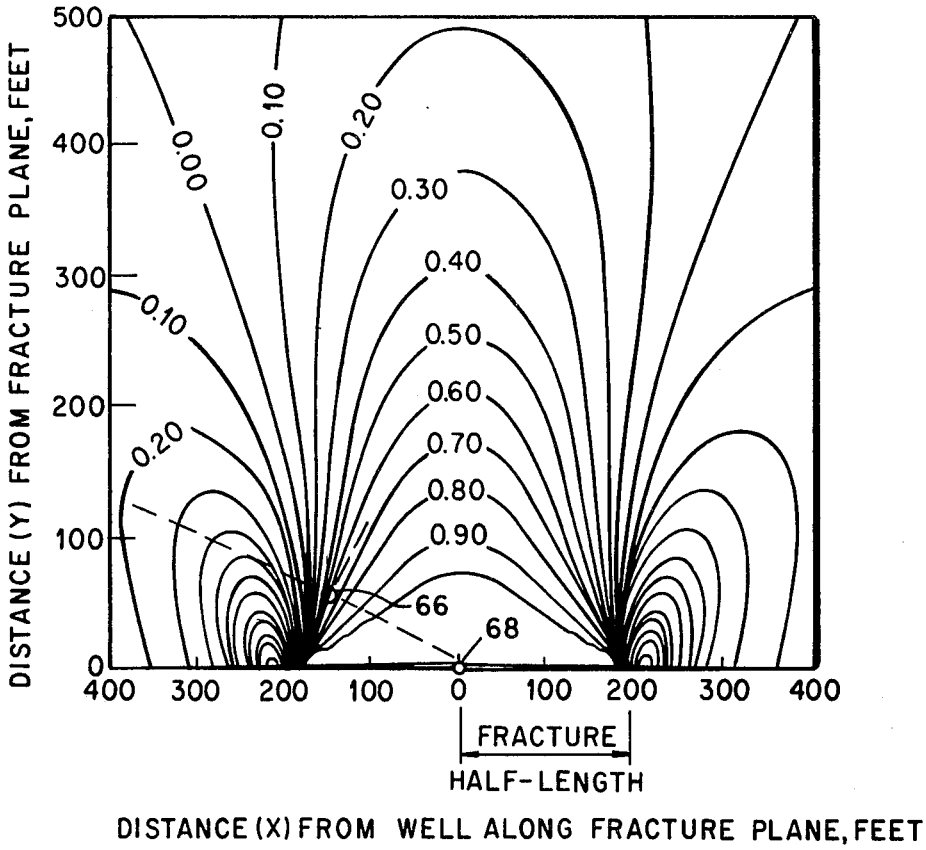
Figure 18:
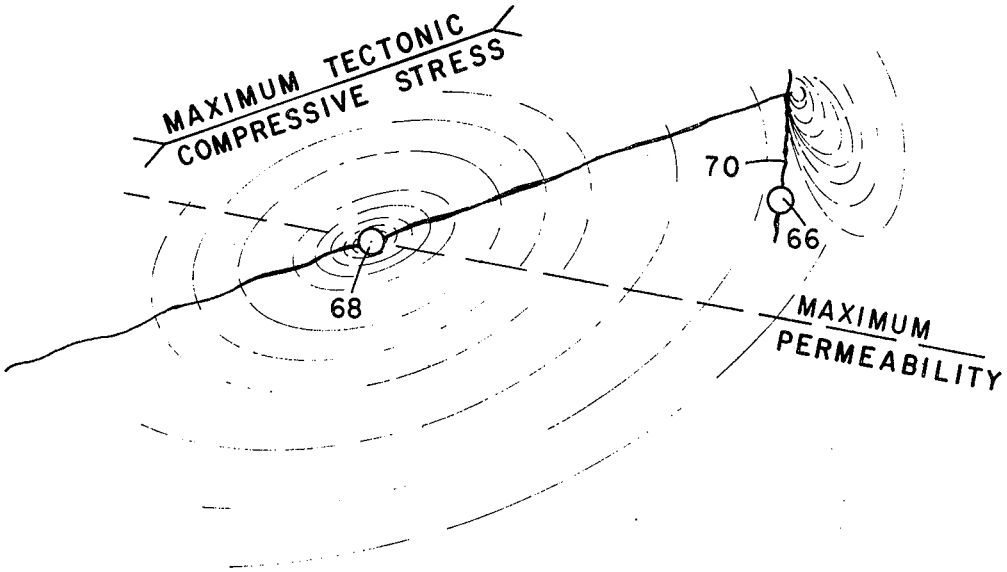

FIG. 17 is a plot showing the ratio of induced stress ($\sigma_{yy}$) to pressure difference ratio ($p_o - p_i$) especially with respect to the concentration of stresses at the tips of the fracture and the distribution of the stresses with respect to the wellbore; and FIG. 18 is an illustration showing the departure of the plane of maximum permeability from the plane of the maximum tectonic compressive stress field with a fracture oriented perpendicularly to the plane of maximum permeability by inducing a fracture in the vicinity of a tip of a fracture projecting from a wellbore along a plane parallel to the plane of the maximum tectonic compressive stress field.

Figure 1:
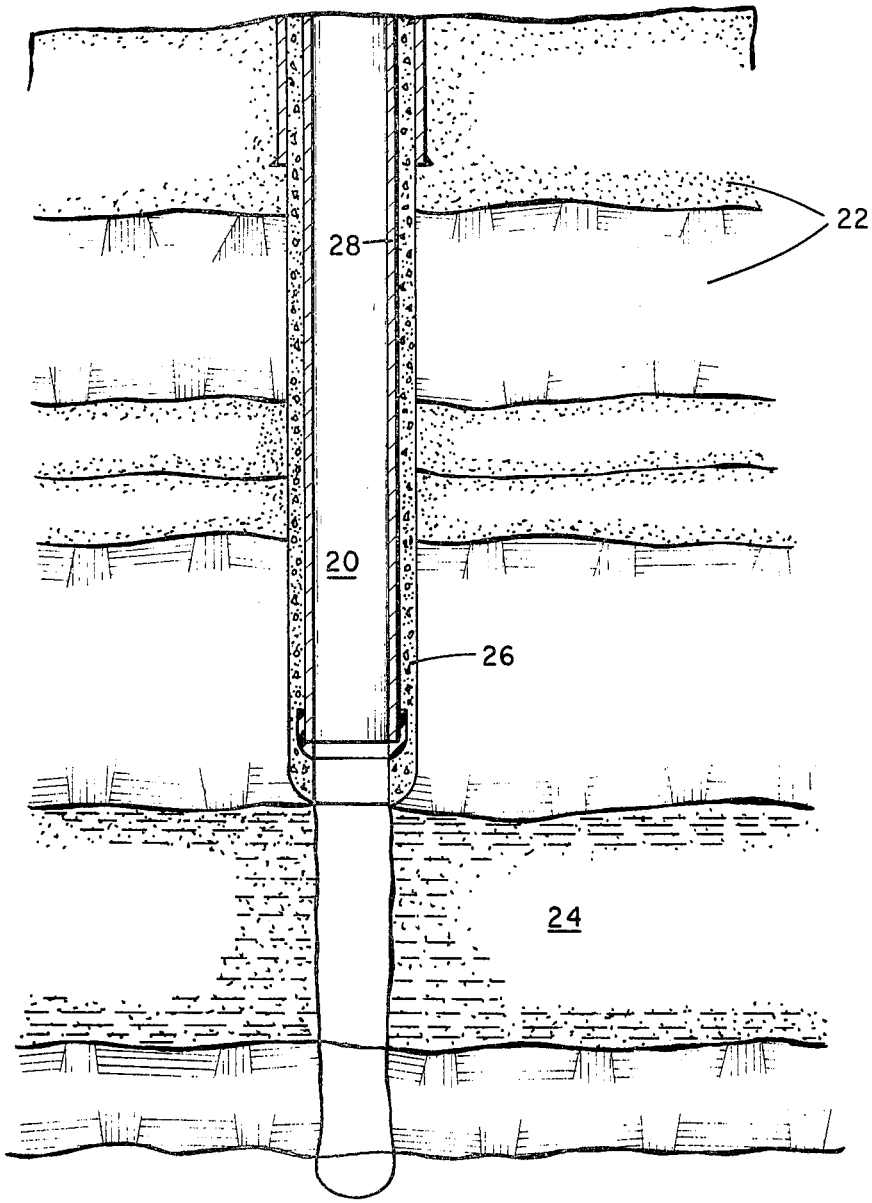
FIG. 1 is a somewhat schematic sectional view showing a typical completed wellbore penetrating several geological formations including an oil-bearing sandstone formation.
Figure 3:
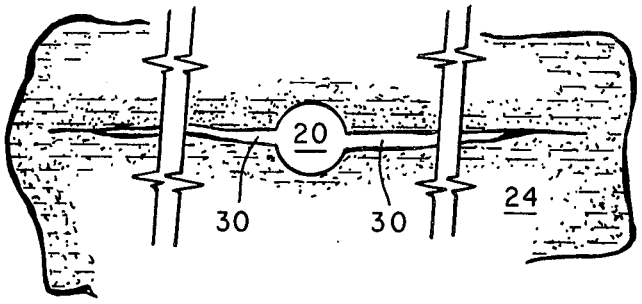
FIG. 3 is a plan view of FIG. 2 showing further configurations of the vertical fracture.
Figure 2:
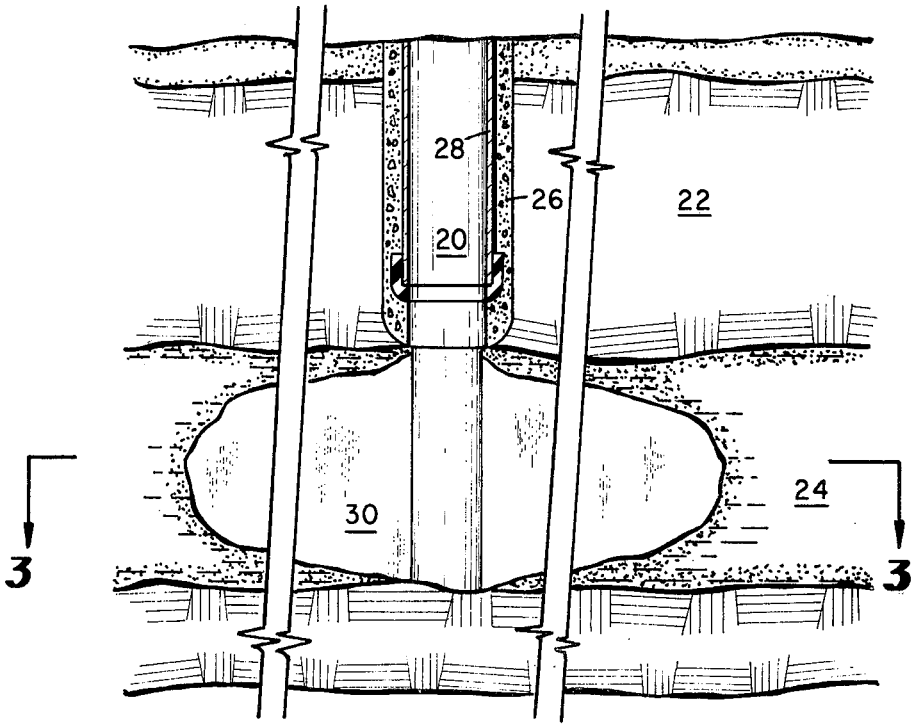
FIG. 2 is an elevational view schematically illustrating the general configuration of an induced fracture disposed in a vertical orientation.

As shown in FIGS. 1–3 of the drawings, a typical well drilling and completion operation may comprise drilling a suitable wellbore 20 through a series of geological formations 22 to the top of the oil-bearing sandstone bed or formation 24, at which point a concrete slurry 26 is pumped into a casing 28 disposed within the bore 20 and forced up about the outer surface of the casing 28 to completely enclose the casing and seal the bore from communication with fractures and the like in the surrounding earth formations. The wellbore is then drilled through the oil-bearing sandstone to some depth, e.g., about 30 feet, below the sandstone formation. Upon completing the wellbore and the withdrawal of oil by primary recovery operations, as available, or prior to such recovery, the wellbore in the sandstone formation may be fractured by pumping a fracture inducing fluid into the wellbore until the pressure of the fluid reaches the critical breaking strength of the sandstone formation, whereupon a fracture 30 initiates from the wellbore and propagates in two opposite directions from the wellbore as shown in FIGS. 2 and 3. Following the initial formation of the fracture 30, various injection rates and fluids may be used to extend the fracture. Also sand or some other particulate material may be admixed with the fracturing fluid to prop open the fracture and thereby prevent the closing thereof when the pressure of the injection fluid is decreased and the well is placed in a production mode. The extension of the fracture may be accomplished in various stages, rates, and times during the production of life of the well. The illustration in FIGS. 2 and 3 shows the fracture 30 as a vertically oriented fracture extending approximately uniform distances on either side of the wellbore 20. However, it is to be understood that the fracture may extend a substantially greater distance in one direction than in the other and is shown as being of uniform dimensions merely for the purpose of illustration.

Figure 4:
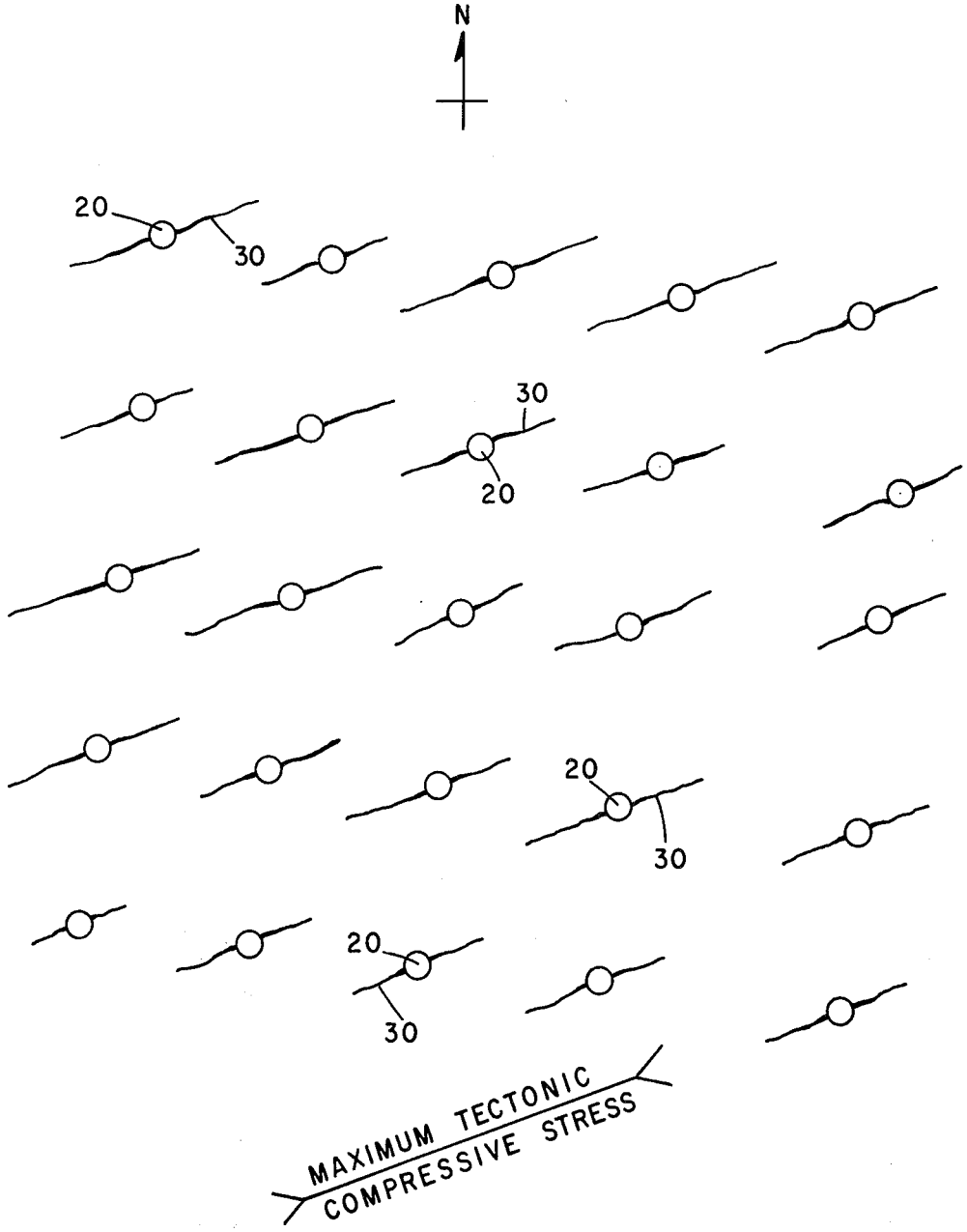
FIG. 4 is a plan view showing an oil field containing induced fractures with the fracture orientation or direction typically dictated by the maximum tectonic compressive stress field.

In fracturing oil-bearing, sub-surface sandstone formations, the path or direction of the fracture is dictated by the maximum in situ compressive stress field present in the sandstone adjacent the wellbore. Such a maximum compressive stress field found to be present in all subterranean earth formations is the tectonic or naturally occurring compressive stress field. Thus, in a typical oil field in the northeastern United States where the maximum tectonic stress field lies in a plane extending in approximately a N 70° E direction, as schematically shown in FIG. 4, the wellbores 20 when fractured by employing conventional fracturing procedures will produce a fracture pattern wherein all the fractures 30 are oriented in a generally parallel array in the direction of the tectonic stress field. While such a fracture pattern will considerably increase the productivity or efficiency of the recovery operation, it will appear clear that considerable areas of the sandstone formation are left untouched by the fractures due to their parallel orientation so as to inhibit recovery of an excessively large percentage of the oil present in the oil field. Typically, in such oil fields tertiary recovery procedures such as water flooding may be utilized to force oil from the sandstone to further increase the recovery efficiency. However, again the parallel orientation of the fractures considerably limits the total productivity of the well system.

It was found that the tectonic or the naturally occurring maximum compressive stress field existing in situ in sub-surface earth formations can be negated and, in effect, altered sufficiently so that the plane of the maximum compressive stress field present in the formation may be re-oriented, thereby providing a method by which the direction of an induced fracture emanating from a wellbore may be selectively controlled. This method of selectively stressing earth formations adjacent to wellbores for orienting the fracture path is not affected by various conditions in the sub-surface earth strata, such as non-isotropic or non-homogeneous materials of differing boundary conditions which are known to affect the properties of the tectonic stress fields. In the method of the present invention the direction of the fracture, initiation and extensions thereof are largely problems of stability with other variables present, such as maximum and minimum principal compressive stresses, maximum shear stresses, material directional properties, minimal energy, and least work. In fact, the maximum compressive stress field is the major factor involved in the directional control of induced fractures and is the factor being modified by the method of the invention.

Figure 5:
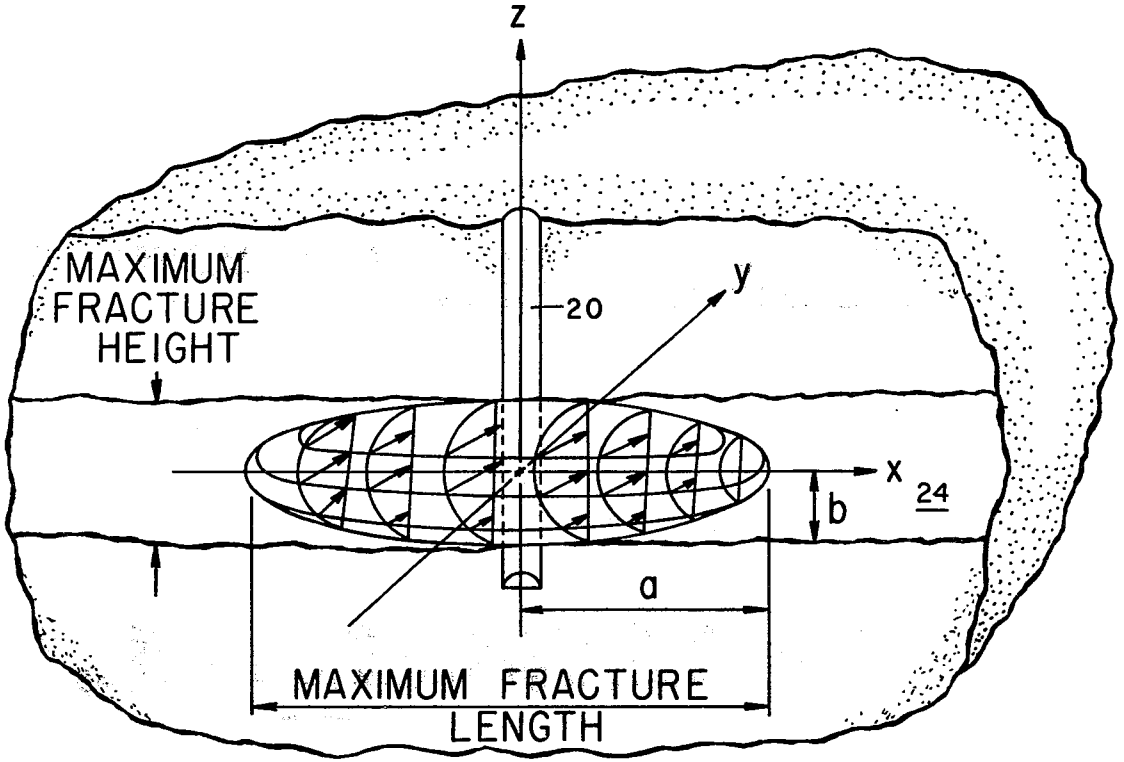
FIG. 5 is a schematic showing of a three-dimensional solid with ellipsoidal pressure load placed on an elliptical area defined by a vertical fracture.

As shown in FIG. 5 the simplest and most accurate mathematical representation of the conditions being modified in the sand formation surrounding the wellbore by applying a stress load to the fracture walls is that of an ellipsoidal load on an elliptical area of a three-dimensional half space. The pressure loading $P(x,y)$ in the area surrounding the wellbore in a fractured cavity is given by the expression:

$$P(x,y) = (P_o - P_i)\left[1 - \left(\frac{x}{a}\right)^2 - \left(\frac{y}{b}\right)^2\right]^{1/2}$$

The stress change induced by the pressure loading in the Y direction, as an example, is then given by the expression $$\sigma_{yy}(o,y,o) = (P_o - P_i)\frac{\sqrt{1-\epsilon^2}}{\rho\sqrt{\rho^2-\epsilon^2}}$$

where $$\epsilon = \sqrt{1-\left(\frac{b}{a}\right)^2}\text{; and}$$

$$\rho = \sqrt{1+\left(\frac{y}{a}\right)^2}.$$

Figure 6:
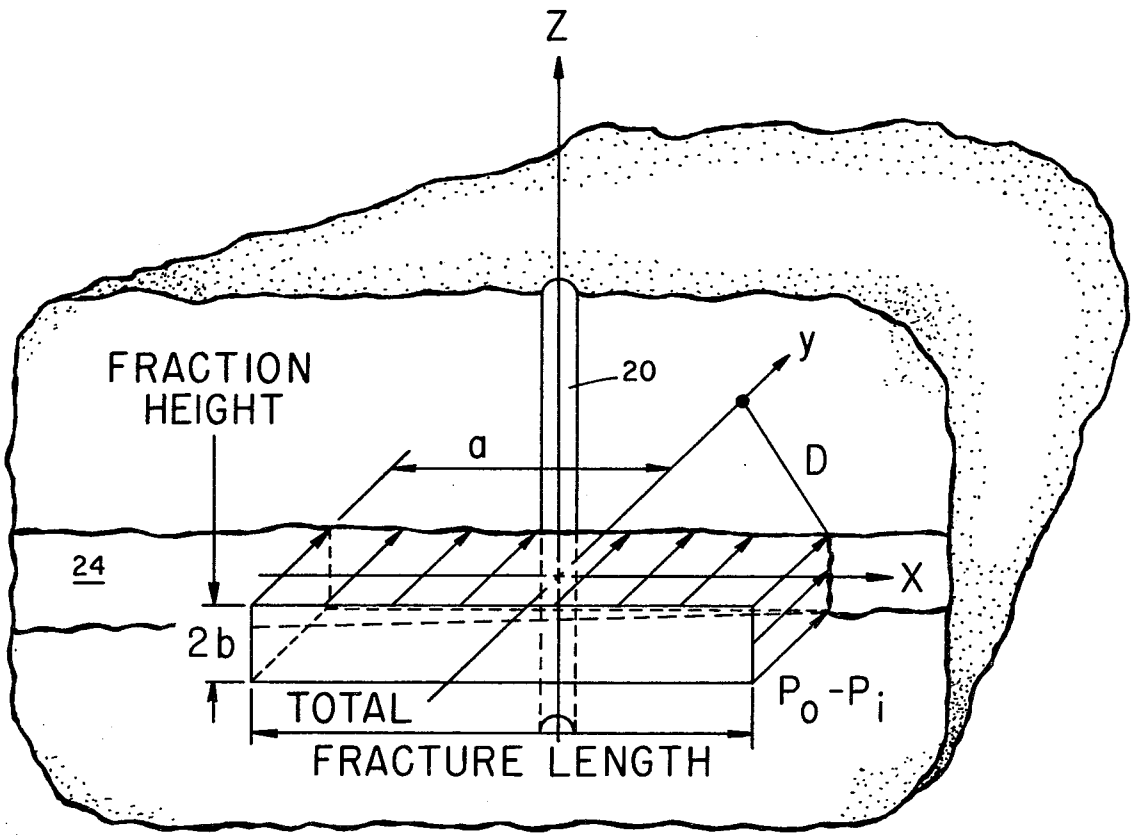
FIG. 6 is a schematic showing of a three-dimensional solid somewhat similar to FIG. 5 but showing a rectangular pressure loading on a rectangular area defined by a vertical fracture and a more perfect fracture created in a less permeable formation by a more viscous fluid.

In FIG. 6 there is shown another representation of the sub-surface earth formation being modified by injecting a fracturing fluid into the wellbore to stress the nearby strata via a fracture. In this figure, a uniform rectangular load on a three dimensional half space is shown. This figure describes the stress distribution $\sigma_{yy}(o,y,o)$, and is given by the expression:

$$\sigma_{yy}(o,y,o) = \frac{2(P_o - P_i)}{\pi}\left[\frac{aby}{D}\left(\frac{a^2+b^2+2y^2}{a^2b^2+D^2y^2}\right) + \sin^{-1}\left(\frac{ab}{(a^2+y^2)\sqrt{b^2+y^2}}\right)\right]$$

where $D = \sqrt{a^2+b^2+y^2}.$

Figure 7:
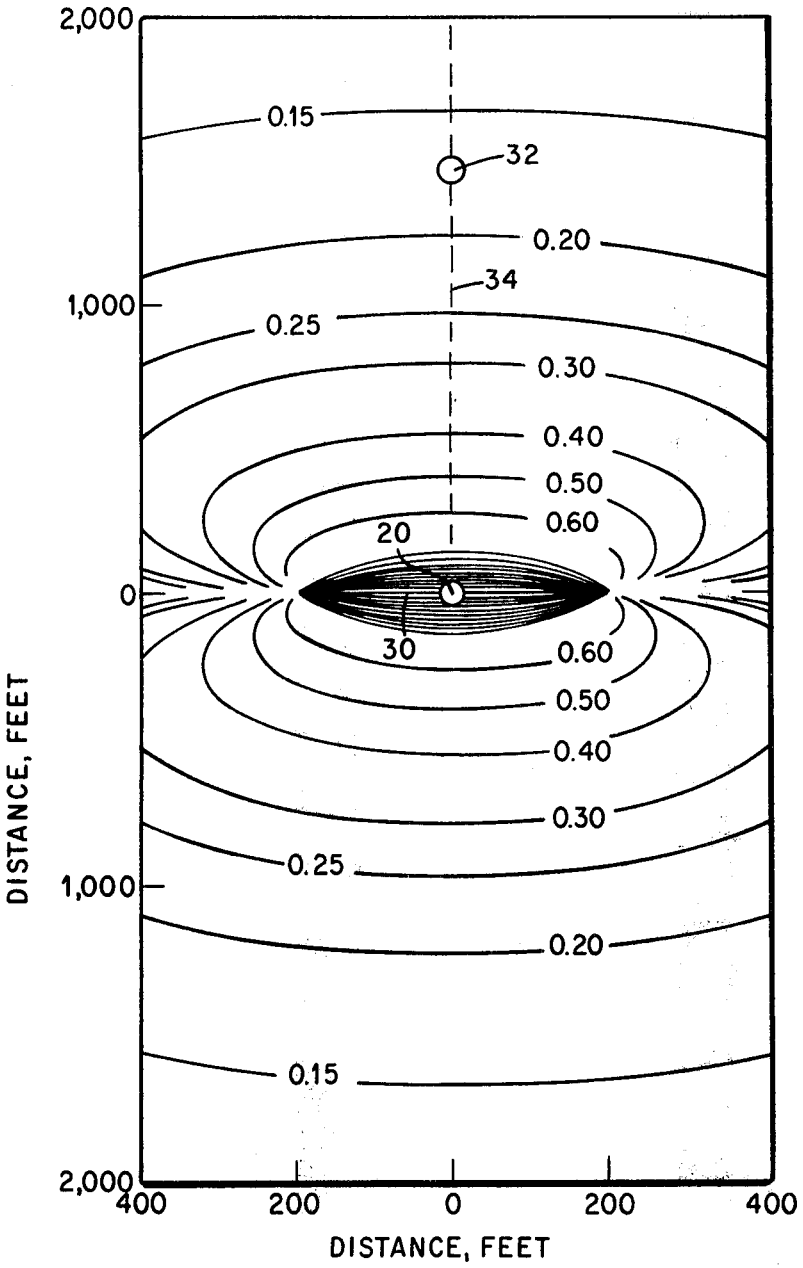
FIG. 7 is a plot generally illustrating the distribution of induced stress to pressure difference ratio $\sigma_{yy}/(p_o - p_i)$ for a fractured well.

In FIG. 7 there is shown a plot indicative of the induced stress ($\sigma_{yy}$) to pressure difference ratio ($P_o - P_i$) as a function of the horizontal dimension of the sub-surface formation. In this plot a wellbore 20 having a fracture 30 propagating therefrom as may be formed in the usual previously employed fracturing manner along the plane of the maximum tectonic stress field is pressurized with a suitable high pressure fluid to create a stress field emanating in radial directions with respect to the plane of the fracture 30. This stress field may be made to propagate a sufficient distance from the fracture 30 so as to encompass a wellbore 32 located in a location orthogonally spaced from the plane of the fracture 30 and in general alignment with the wellbore 20. With the induced stress at a sufficiently high level encompassing this wellbore 32, the tectonic compressive stress field naturally stressing the earth strata about wellbore 32 has, in effect, been negated and re-oriented along a plane generally indicated by the dotted line 34 projecting between the wellbores 20 and 32. As little as 1.0 psi difference between the tectonic stress and the induced stress is sufficient for the latter to negate the tectonic stress field. When stressing the earth formation adjacent a previously fractured wellbore inhomogeneities, natural fractures, directional planes of weakness, and other naturally occurring conditions in the earth formation do not adversely affect the stressing step utilized for the re-orientation of the maximum compressive stress field.

Figure 8:
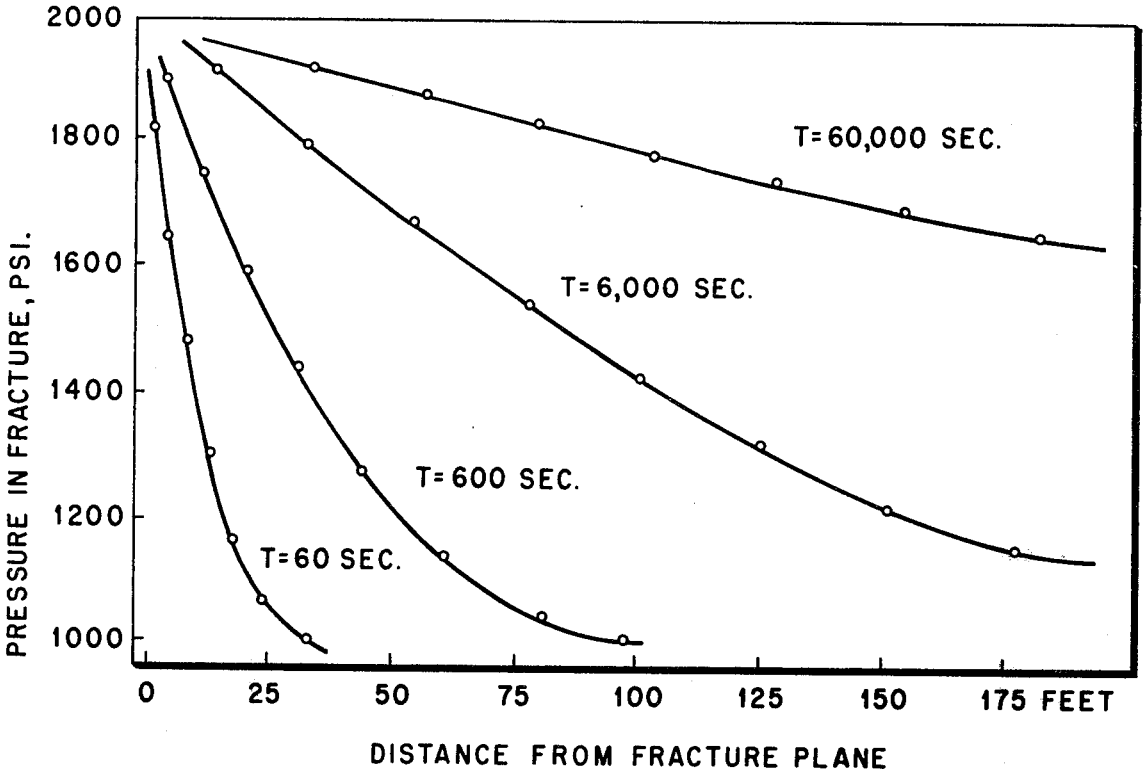
FIG. 8 is a plot illustrating pressure distribution in a highly permeable sandstone reservoir at various times after fluid injection at 2000 psi in a reservoir having an initial pressure loading of 1000 psi.
Figure 9:
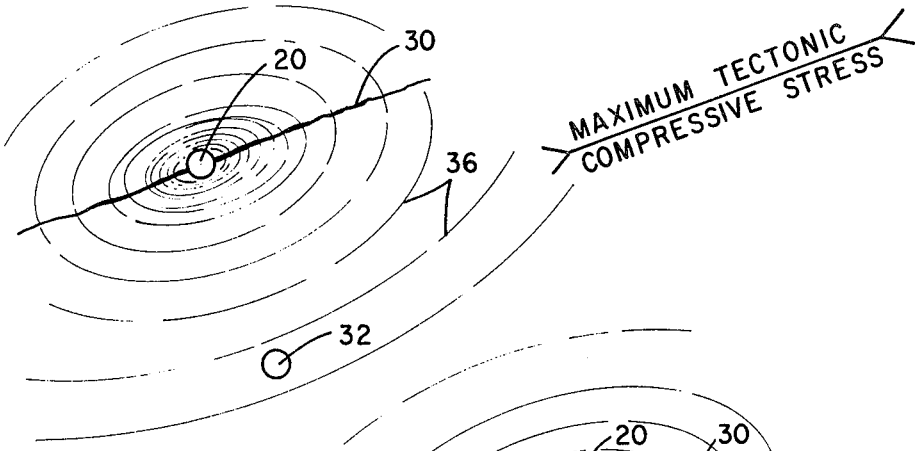
FIGS. 9–13 are illustrations showing the selective control of the direction of fracture initiation and extension by utilizing both natural and induced compression conditions in the reservoir sandstone for the purpose of selectively orienting the fracture system.
Figure 10:
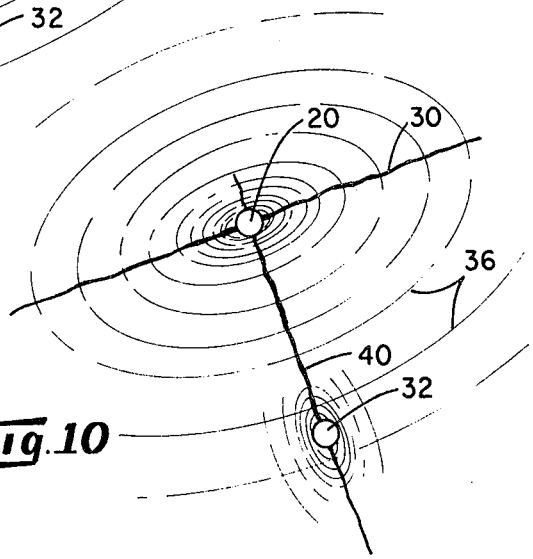

As shown in FIG. 8, the induced in situ compressive stress extending between wellbores 20 and 32 as in FIG. 7, is time dependent with the stress increasing with time at increasing distances from the fracture plane. In the FIG. 8 plot, the pressure distribution with time was achieved by pressurizing a wellbore having an initial pressure of 1000 psi with a liquid at 2000 psi.

With reference to FIGS. 9–13, the method of the present invention may be practiced by the steps of initially fracturing the selected earth formation surrounding wellbore 20 (FIG. 9) by pumping high pressure liquids into wellbore 20. The direction of the resulting fracture 30 is dictated by the presence of the maximum tectonic compressive stress field so as to extend along a plane parallel thereto. After completing the fracture 30 to a desired size, high pressure liquid is pumped into wellbore 20 to create the stress field in the earth formation generally shown by the dotted line 36. As this stress field propagates radially from the fracture 30 it encompasses the second wellbore 32 so as to negate the tectonic stress field in this area and, in effect, re-orients the maximum compressive stress field in a plane disposed orthogonally to the plane of the fracture 30. Wellbore 32 may be separated from wellbore 20 a distance dictated by various factors, such as the thickness of the sandstone formation, its porosity, the extent of fracturing desired, and various other factors. While this spacing between wellbores is not critical, it must necessarily be such that the induced stress reaching wellbore 32 will be just slightly greater than the tectonic stress field normally present so as to negate the effect of the latter with respect to dictating the direction or orientation of a fracture emanating from wellbore 32. The steps of fracturing the wellbore 20 and the stressing of the surrounding earth formation are accomplished simultaneously. Further, the step of stressing the earth formation at the second wellbore may be accomplished at any desired period of time after the fracture in the first wellbore is completed. With the stress field emanating from wellbore 20 encompassing wellbore 32 (FIG. 10) and the tectonic compressive stress field about wellbore 32 negated, the latter wellbore is pressurized with a suitable hydraulic fluid to a pressure of sufficient value to effect formation breakdown. At this time a fracture 40 will be initiated at wellbore 32 and extend toward wellbore 20 so as to lie in a plane approximately normal to the fracture 30. Extension of this fracture 40 may be accomplished by continuing the pressurizing of wellbore 32. While this fracture 40 is shown intersecting wellbore 20, it is to be understood that these fractures are shown intersecting or in alignment with one another merely for the purpose of illustration and may or may not be in alignment or as extensive as shown. In fact, with relatively large spacings between wellbores, the chances of the fractures intersecting or being in alignment with one another, as shown in the drawings, are highly marginal. However, such fracture intersection or alignment is not necessary for the successful practice of the present invention. Further, in practicing the present invention a pair of wellbores such as 32 may be placed one on each side of a fractured wellbore corresponding to wellbore 20 so that the pressurization of the latter will provide the plane of maximum compressive stress in the earth formation adjacent the pair of wellbores. This pair of wellbores may then be selectively or simultaneously pressurized to induce fractures in the surrounding earth formation corresponding to fracture 40.

Figure 11:
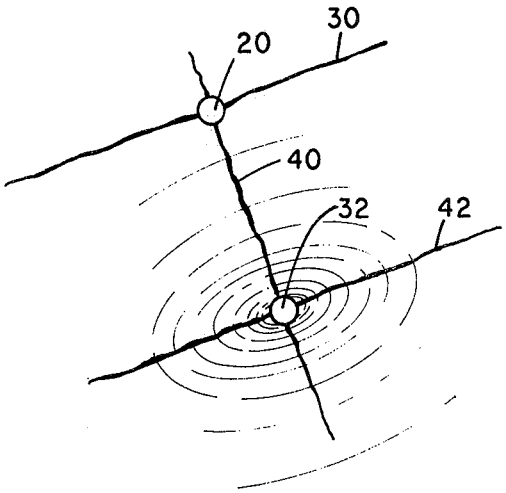
Figure 12:
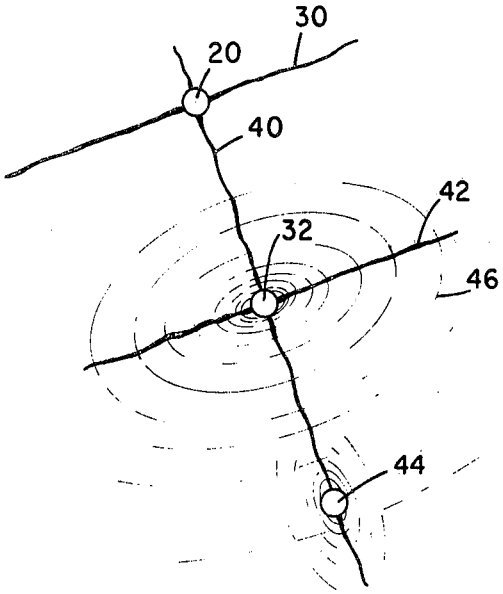
Figure 13:
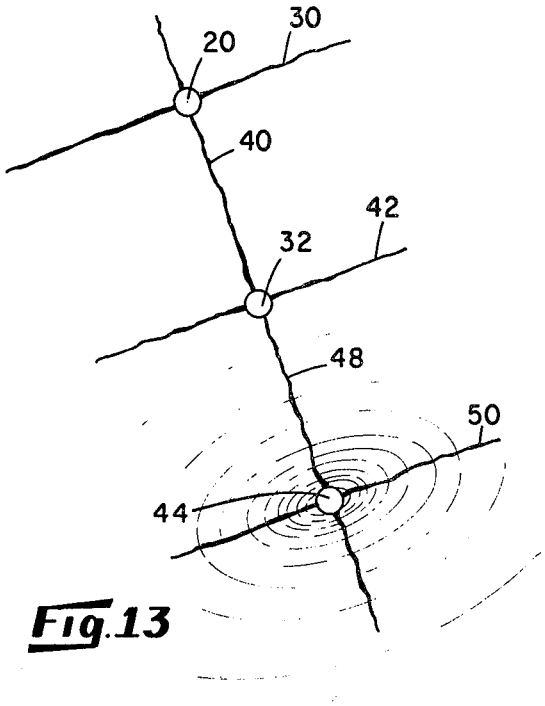

With the completion of the fracture 40, the induced pressure field 36 from wellbore 20 is allowed to drop (FIG. 11) so that the tectonic compressive stress field about wellbore 32 which had been negated by the stress field 30 is again present. Thus, the pressurization of wellbore 32 causes a further fracture 42 to propagate from wellbore 32 with this fracture extending along a plane parallel to fracture 32 due to the influence of the now present tectonic stress field, as shown in FIG. 11. The procedure for re-orienting the maximum compressive stress field as previously described may then be repeated with even a further wellbore, as shown in FIG. 12 at 44. To provide a fracture from wellbore 44 the fluid pressure in wellbore 34 may be reinstated or, if desired, maintained from the previous fracturing operation to produce a stress field 46 projecting therefrom which negates the tectonic compressive stress field with respect to the laterally off-set wellbore 44. While this wellbore 44 is under the influence of the stress field 35 emanating from wellbore 34, it is pressurized with fluid to cause a fracture 48 (FIG. 13) to initiate and extend toward and, if desired, intersect with wellbore 32. Again, as shown in FIG. 13, a pressure drop in wellbore 32 will terminate the stress field influencing the fracture orientation emanating from wellbore 46. Thus, with the pressure in wellbore 44 at the formation breakdown pressure a fracture 50 will be provided along a plane parallel to the fractures 30 and 42.

Accordingly, as described above and generally shown in FIGS. 9–13, by practicing the method of the present invention induced fractures may be established in subterranean earth formations along planes orthogonal to the fracture system dictated by the presence of the tectonic stress field. Further, by employing the subject method the oil-recovery efficiency and rate of recovery are greatly increased since the fractures 40 and 48 will normally project through the sandstone formation along planes perpendicular to the plane of maximum permeability of the sandstone formation.

Figure 14:
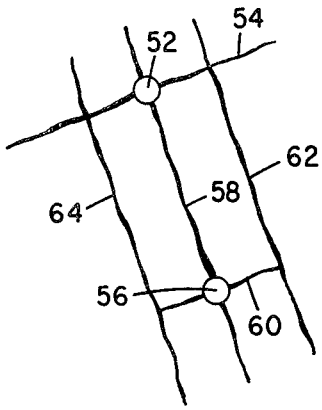
FIGS. 14 and 15 are illustrations showing that the induced stress conditions and the naturally occuring tectonic stress conditions may be utilized for the purpose of providing multiple fractures or fracture furcation in adjacently-disposed wellbores.
Figure 15:
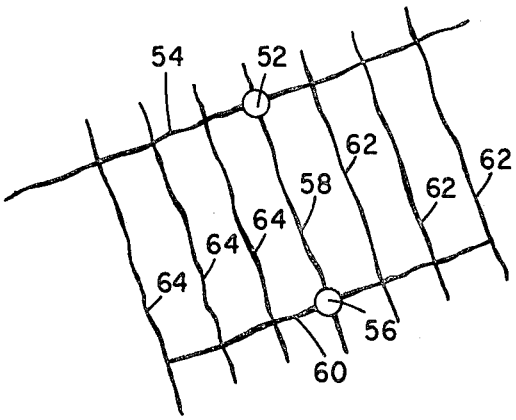

It was also found that by selectively and alternately increasing or decreasing the pressure in adjacent wells, a furcation of the fracture system may be readily provided. As generally shown in FIGS. 14 and 15, the furcation of the fractures emanating from adjacent wellbores may be provided by first pressurizing a previously fractured wellbore 52 having a fracture 54 projecting therefrom to an extent adequate to provide wellbore 56 with a plane of maximum compressive stress in a direction orthogonal to fracture 54. Thus, as described above in connection with FIGS. 9–13, the pressurization of wellbore 56, while under the influence of this maximum compressive stress field, will induce a fracture 58 which propagates toward wellbore 52 along a line orthogonal to the fracture 54. Upon completion of this fracture 58, the fluid pressure in wellbore 52 is terminated or dropped to a level less than that which will negate the naturally occurring tectonic stress field at wellbore 56. With the removal of this induced stress and with the pressure within wellbore 56 created statically, dynamically, and/or pulsed above the formation breakdown pressure, a further fracture 60 will be initiated in wellbore 56 and project along a plane parallel to fracture 54. This fracture is allowed to propagate for only a relatively short distance and then the pressure in wellbore 56 is dropped below the formation breakdown pressure as to prevent the crack or fracture from extending any further. At this point, wellbore 52 is again pressurized to realign the maximum compressive stress field in a plane orthogonal to the tectonic stress field and place wellbore 56 under the influence of this re-oriented stress field. Wellbore 56 is then further pressurized to cause a pair of fractures 62 and 64 to extend from the tips of the fracture 60 back toward fracture 54 or wellbore 52. These fractures 62 and 64 may propagate from either tip of the fracture 60, depending upon numerous variables, in a sequential or stepwise fashion. As shown in FIG. 15, the furcation of the fracture system may be repeated several times until the fracture system, in effect, completely exposes the sand formation between adjacent wellbores to a fracture array which will significantly increase the oil recovery efficiency and rate of recovery.

Figure 16:
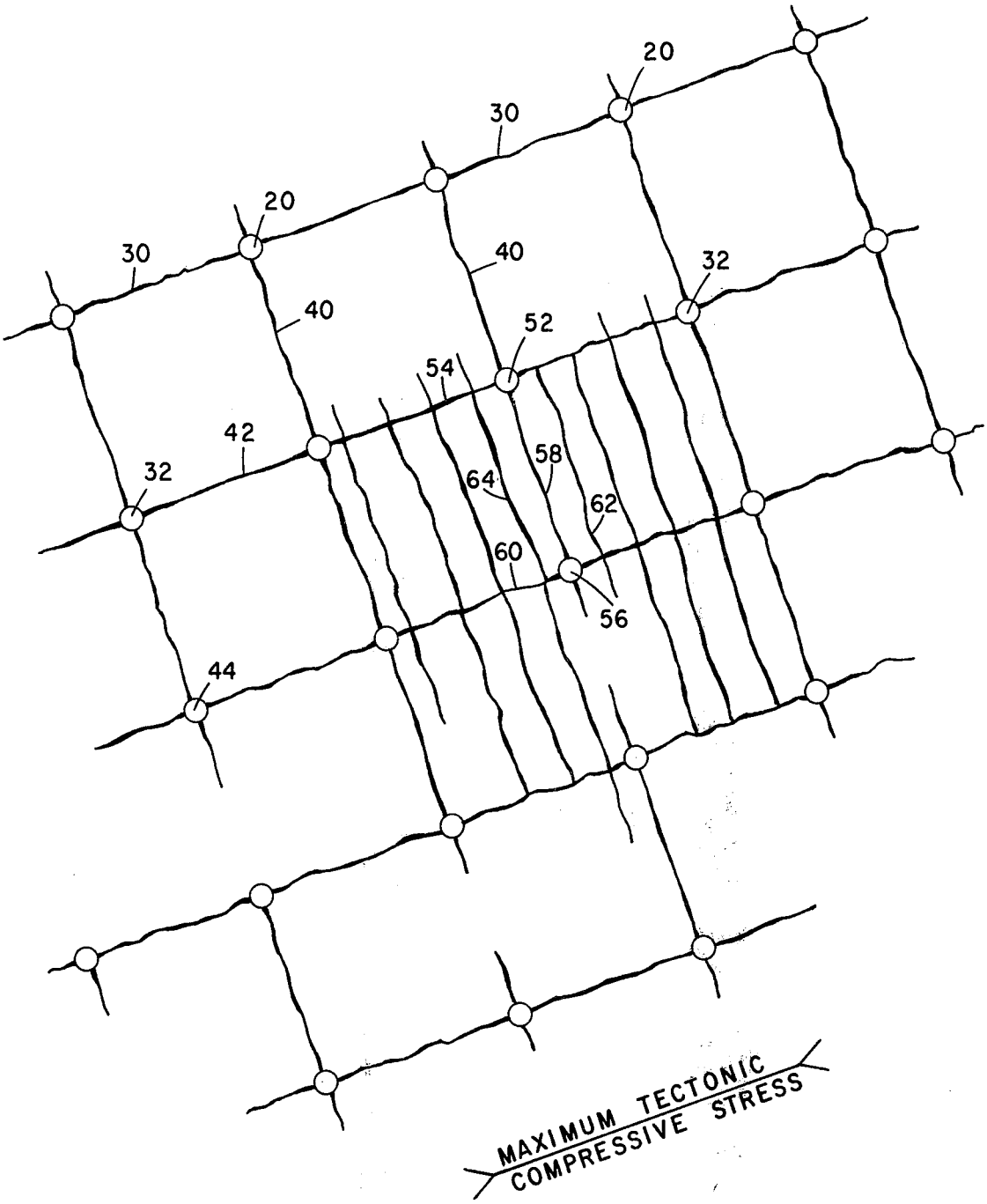
FIG. 16 is a somewhat schematic illustration showing an oil field containing a plurality of wellbores with interconnecting fracture systems as well as multiple fracture systems as could be realized by practicing the method of the present invention.

In FIG. 16, there is shown an oil field somewhat similar to that in FIG. 4 but differing therefrom in that the fracture system is not dictated wholly by the presence of the tectonic compressive stress field. Thus, by practicing the method of the present invention in a new or previously fractured oil field, it will appear clear from FIG. 16 that the sandstone or, for that matter, any other energy resource-containing subterranean strata, may be extensively fractured so as to expose a considerably greater area thereof and thereby greatly enhance the productivity or efficiency of the recovery operation. In fact, as shown in this figure, furcating the fractures is still a further advantage in that the fracture systems are very extensive and may be utilized in block fracturing oil shale to facilitate in situ gasification by direct combustion or for the purpose of rubbling the oil-bearing shale with liquid explosives pumped into the fracture system.

In FIGS. 17 and 18, there is shown a still further embodiment of the present invention which is particularly advantageous in the event the plane of maximum permeability in the sandstone is not parallel to the maximum tectonic compressive stress field. While this plane of maximum permeability is usually parallel to the tectonic stress field, it may be slightly offset therefrom by as much as about 10° to 20° so as to detract the recovery efficiency gained by using the method of the present invention as previously described. It is known that in a wellbore which has been pressurized to stress the surrounding sub-surface formation the concentration of the stress field at the tips of the fracture is significantly greater than at the wellbore. This stress concentration, as shown in FIG. 17, is due to the configuration of the relatively sharp points at the fracture tips with respect to the larger relatively smooth surface area defining the wellbore initially subjected to the pressure. Thus, as shown in FIG. 18, in order to provide a fracture which will intersect the plane of maximum permeability at essentially 90°, a wellbore 66 is provided near the tip of a previously fractured wellbore 68 so that by practicing the present invention as previously described, the pressurization of the previously fractured wellbore 68 will re-orient the tectonic stress field at the fracture tip along planes extending in several radial directions from the fracture tip. Thus, by positioning the wellbore 66 at a prescribed point $(x, y)$, e.g., within about 50 feet of the fracture, and at a particular tangent to the preferred stress level emanating from the tip and then pressurizing this wellbore 66, a fracture 70 will project from the wellbore 66 toward the tip so as to orthogonally intersect the plane of maximum permeability. Upon completion of this fracture the remainder of the field may be fractured by practicing the method essentially similar to that disclosed in FIG. 9–16, except that instead of returning previously fractured wellbores to the tectonic maximum compressive stress field, it is necessary to hydraulically stress wellbore 66 and each wellbore subsequent to wellbore 66 to provide a maximum compressive stress field in a plane orthogonal to the previously induced fracture. Thus, the field can be developed to provide a configuration similar to that shown in FIG. 16 but with well fractures orthogonally intersecting the plane of maximum permeability to increase rates and total productivity.

It will be seen that the present invention represents a significant contribution to the art of recovering energy resources from subterranean earth formations so as to substantially increase the energy reserve of such resources as well as the recovery efficiency in territories of the United States and locations throughout the world. Further, the subject method can be advantageously employed for the purpose of controlling the direction of fracture initiation and growth in any subsurface geological material which may or may not contain energy resources. While the above description is primarily directed to the selective orientation of hydraulically-induced fractures in subterranean earth formations with respect to the orientation of the maximum compressive tectonic stress field, the plane of minimum strength in the earth formation may not exactly coincide with the plane of maximum tectonic stress so that the fractures may, in fact, be only generally parallel and orthogonal to the latter. However, the induced stressing steps of the present invention provide for the desired orientation of the induced fractures in the same manner with both the plane of minimum strength and maximum compressive tectonic stress field.

What is claimed is:

1. A method of providing a subterranean earth formation with a hydraulically-induced fracture disposed in a plane substantially orthogonal to the plane of the maximum tectonic compressive stress field, consisting of pressurizing fluid in the first of the first and second wellbores penetrating said earth formation at locations spaced apart from one another along a plane disposed at an angle generally perpendicular to the plane of the maximum tectonic compressive stress field for sufficiently stressing the earth formation surrounding said first wellbore to provide a maximum compressive stress field in said earth formation encompassing said second wellbore and projecting along a plane orthogonal to the plane of the maximum tectonic stress field and extending between said spaced-apart wellbores, and then pressurizing fluid in the second wellbore while maintaining said maximum compressive stress field provided by the pressurization of the fluid in the first wellbore for inducing a fracture in the earth formation adjacent to said second wellbore with said fracture extending toward said first wellbore in a direction substantially parallel to the plane of the maximum compressive stress field projecting therebetween.

2. A method for selectively orienting hydraulically-induced fractures in a subterranean earth formation in which the fractures would normally be disposed along a plane parallel to the plane of the maximum tectonic compressive stress field, the selective orientation of the fractures being achieved by the steps consisting of injecting a fluid into a wellbore penetrating said earth formation and into a previously induced fracture projecting from said wellbore into said earth formation along a plane parallel to said plane of the maximum tectonic compressive stress and pressurizing said fluid for inducing a compressive stress in said earth formation in a plane disposed generally orthogonal to said plane of maximum tectonic compressive stress, continuing the fluid injection until the induced compressive stress in an area of said earth formation contiguous to the previously induced fracture is greater than said maximum tectonic compressive stress so as to negate the latter in said area while simultaneously stressing the earth formation in said plane disposed generally orthogonal to said maximum tectonic compressive stress, and while maintaining the induced compressive stress, injecting fluid into a second wellbore devoid of any previously induced fractures and penetrating said earth formation in said area at a location laterally displaced from the plane of said previously induced fracture and under the influence of said induced compressive stress and pressurizing said fluid in the second wellbore to a pressure above the earth formation breakdown pressure for effecting a fracture in the earth formation adjacent to the second wellbore with the last-mentioned fracture projecting along a plane generally parallel to the plane of said induced compressive stress and generally orthogonal to said previously induced fracture.

3. The method claimed in claim 2 including the additional step of decreasing said induced compressive stress in the earth formation adjacent said second wellbore to a level less than said maximum tectonic compressive stress, and pressurizing fluid in said second wellbore for effecting a further fracture therefrom in the earth formation along a plane generally parallel to said previously induced fracture.

4. The method claimed in claim 3, including the additional steps of decreasing the pressure of the fluid in said second wellbore to a level below the earth formation breakdown pressure after initiating said further fracture, pressurizing the fluid in said first-mentioned wellbore to re-establish said induced compressive stress, and while maintaining the re-established induced compressive stress again pressurizing the fluid in said second wellbore and said further fracture to a pressure above the earth formation breakdown pressure for effecting fractures from the ends of said further fracture remote to said second wellbore along plane parallel to and on opposite sides of the fracture disposed orthogonally to said previously induced fracture.

5. A method as claimed in claim 2, wherein said earth formation has a plane of maximum permeability projecting tangentially to said plane of maximum tectonic stress, and wherein said second wellbore is disposed in said earth formation at a location in close proximity to a tip of said previously induced fracture, and wherein said last-mentioned fracture in the earth formation adjacent to said second wellbore extends towards said tip along a plane substantially perpendicular to the plane of maximum permeability.

6. A method for selectively orienting hydraulically-induced fractures in a subterranean earth formation in which the fractures would normally be disposed along a plane parallel to at least one of the plane of minimum strength and the plane of maximum tectonic compressive stress, the selective orientation of the fracture being achieved by the steps consisting of injecting a fluid into a wellbore penetrating said earth formation and into a previously induced fracture projecting from said wellbore into said earth formations along a plane parallel to the first mentioned plane and pressurizing said fluid for inducing a compressive stress in said earth formation in a direction disposed generally orthogonal to said at least one plane of minimum strength or plane of maximum compressive stress, continuing the fluid injection until the induced compressive stress in an area of said earth formation contiguous to the previously induced fracture is greater than the stress along the first mentioned plane so as to negate the latter in said area while simultaneously stressing the earth formation in said plane disposed generally orthogonal to the first mentioned plane, injecting fluid into a second wellbore penetrating said earth formation in said area at a location laterally displaced from the plane of said previously induced fracture and under the influence of said induced compressive stress and pressurizing said fluid in the second wellbore to a pressure above the earth formation breakdown pressure while maintaining said induced compressive stress for effecting a fracture in the earth formation adjacent to the second wellbore with the last-mentioned fracture projecting along a plane generally parallel to the plane of said induced compressive stress and generally orthogonal to the plane of said previously induced fracture.

* * * * *